US008633793B1

(12) United States Patent
Chang et al.

(10) Patent No.: US 8,633,793 B1
(45) Date of Patent: Jan. 21, 2014

(54) COMMON MODE FILTER

(71) Applicant: Inpaq Technology Co., Ltd., Miaoli County (TW)

(72) Inventors: Yu-Chia Chang, Taichung (TW); Ming-Fung Hsieh, Changhua County (TW); Chi-Wei Chen, Changhua County (TW)

(73) Assignee: Inpaq Technology Co., Ltd., Miaoli County (TW)

( * ) Notice: Subject to any disclaimer, the term of this patent is extended or adjusted under 35 U.S.C. 154(b) by 0 days.

(21) Appl. No.: 13/646,596

(22) Filed: Oct. 5, 2012

(51) Int. Cl.
*H01F 5/00* (2006.01)
*H01F 27/28* (2006.01)

(52) U.S. Cl.
USPC ..... 336/200; 336/182; 336/232

(58) Field of Classification Search
USPC ..... 336/200, 232–234, 192, 182
See application file for complete search history.

(56) References Cited

U.S. PATENT DOCUMENTS 6,903,645 B2 * 6/2005 Mizoguchi et al. ..... 336/200
7,091,816 B1 * 8/2006 Ito et al. ..... 336/200
7,663,225 B2 * 2/2010 Kudo et al. ..... 257/700
2003/0137384 A1 * 7/2003 Itou et al. ..... 336/200
2006/0176138 A1 * 8/2006 Ito et al. ..... 336/200
2008/0303621 A1 * 12/2008 Ito et al. ..... 336/200
2009/0066462 A1 * 3/2009 Ito et al. ..... 336/200
2009/0284340 A1 * 11/2009 Nishikawa et al. ..... 336/200
2011/0025442 A1 * 2/2011 Hsieh et al. ..... 336/200

FOREIGN PATENT DOCUMENTS

JP P2000-173824 A 6/2000

* cited by examiner

*Primary Examiner* — Alexander Talpalatski
*Assistant Examiner* — Mangtin Lian
(74) *Attorney, Agent, or Firm* — Li & Cai Intellectual Property (USA) Office

(57) ABSTRACT

The common mode filter of the instant disclosure includes a non-magnetic insulating substrate, a stacked-layer structure, an insulating layer, and a magnetic layer. The stacked-layer structure is arranged on the non-magnetic insulating substrate. The magnetic layer is covered on the stacked-layer structure by the insulating layer arranged therebetween. The stacked-layer structure comprises a first coil and second coil, wherein the first coil is coupled to the second coil to suppress the common mode noise. Specially, a width W (mm) and a length L (mm) of at least one coil in the first and second coils satisfy the relational expression of:

$$[(14.1-fc)/6.5]^2<L/W<[(16.7-fc)/4.5]^2$$

Where fc (MHz) is the cutoff frequency of a differential-mode signal.

5 Claims, 8 Drawing Sheets

COMMON MODE FILTER

BACKGROUND OF THE INVENTION

1. Field of the Invention

The instant disclosure relates to a common mode filter; in particular, to a thin-film common mode filter for a portable electric device.

2. Description of Related Art

Common mode filter is a component used to suppress common mode current that causes electromagnetic interference (EMI) conducted on parallel lines in the same direction as a source of the noise in electronic circuit. To address the miniaturizing requirement of portable electronic apparatuses, thin-film common mode filters have been developed.

Japanese Patent Application Laid-Open NO. 2000-173824A discloses one type of electronic component, which includes an insulating substrate, a multi-layer structure, and a plurality of external electrode terminals. The multi-layer structure is arranged on the insulating substrate and comprises a plurality of conducting patterns and a plurality of insulating layers, wherein two of the conducting patterns are laminated with one insulating layer interposed therebetween for electrically insulating the conducting patterns. The external electrode terminals are surroundingly arranged on the insulating substrate and the multi-layer structure for establishing an external electrical connection. Moreover, the electronic component further comprises a plurality of magnetic layer or sheet to cover at least part of the conducting patterns.

For such structural design, the electronic component needs to modify the conducting patterns of the multi-layer structure to adjust the common mode impedance. However, more improvements may cause the large volume of the electronic component and affect the process variables due to the complex structure of the electronic component.

To address the above issues, the inventors strive via industrial experience and academic research to present the instant disclosure, which can effectively improve the limitations described above.

SUMMARY OF THE INVENTION

The object of the instant disclosure is to provide a common mode filter having simple structural configuration to achieve the purpose of miniaturization.

In order to achieve the aforementioned objects, according to an embodiment of the instant disclosure, the common mode filter includes a non-magnetic insulating substrate, a first coil body, a first electric insulating layer, a coil leading layer, a second electric insulating layer, a second coil body, an insulating layer, and a magnetic layer.

The first coil body is arranged on the non-magnetic insulating substrate and comprises a first spiral coil. The coil leading layer is stacked above the first coil body. The first electric insulating layer is arranged between the first coil body and the coil leading layer and has a first conducting structure formed thereon, wherein the first coil body and the coil leading layer are respective electrically coupled to the first conducting structure. The second coil body is stacked above the coil leading layer and comprises a second spiral coil. The second electric insulating layer is arranged between the coil leading layer and the second coil body and has a second conducting structure formed thereon, wherein the coil leading layer and the second coil body are respective electrically coupled to the second conducting structure. The insulating layer is arranged on the second coil body.

Specially, a width W (mm) and a length L (mm) of at least one spiral coil in the first and second spiral coils satisfy the relational expression of:

$$[(14.1-fc)/6.5]^2<L/W<[(16.7-fc)/4.5]^2$$

where fc (MHz) is the cutoff frequency of a differential-mode signal.

According to another embodiment of the instant disclosure, the common mode filter includes a non-magnetic insulating substrate, a lower leading layer, a first electric insulating layer, a first coil body, a second electric insulating layer, a second coil body, a third electric insulating layer, an upper leading layer, an insulating layer, and a magnetic layer.

The lower leading layer is arranged on the non-magnetic insulating substrate. The first coil body is stacked above the lower leading layer and comprises a first spiral coil. The first electric insulating layer is arranged between the lower leading layer and the first coil body and has a first conducting structure formed thereon, wherein the lower leading layer and the first coil body are respective electrically coupled to the first conducting structure. The second coil body is stacked above the first coil body and comprises a second spiral coil. The second electric insulating layer is arranged between the first coil body and the second coil body.

The upper leading layer is stacked above the second coil body. The third electric insulating layer is arranged between the second coil body and the upper leading layer and has a second conducting structure formed thereon, wherein the second coil body and the upper leading layer are respective electrically coupled to the second conducting structure. Specially, a width W (mm) and a length L (mm) of at least one spiral coil in the first and second spiral coils satisfy the relational expression of:

$$[(15.4-fc)/14.3]^2<L/W<[(18.2-fc)/12.0]^2$$

where fc (MHz) is the cutoff frequency of a differential-mode signal.

Base on above, the first and second spiral coils can be magnetically coupled to be used in common to eliminate common mode noise. In addition, the common mode filter is effective in maintaining range of the cutoff frequency by stacking the first and second spiral coils above the non-magnetic insulating substrate to accurately control the common mode impedance and achieve the purpose of miniaturization.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Unless stated otherwise, all mentioned quantities are not intended to be limiting.

The First Embodiment

Figure 1:
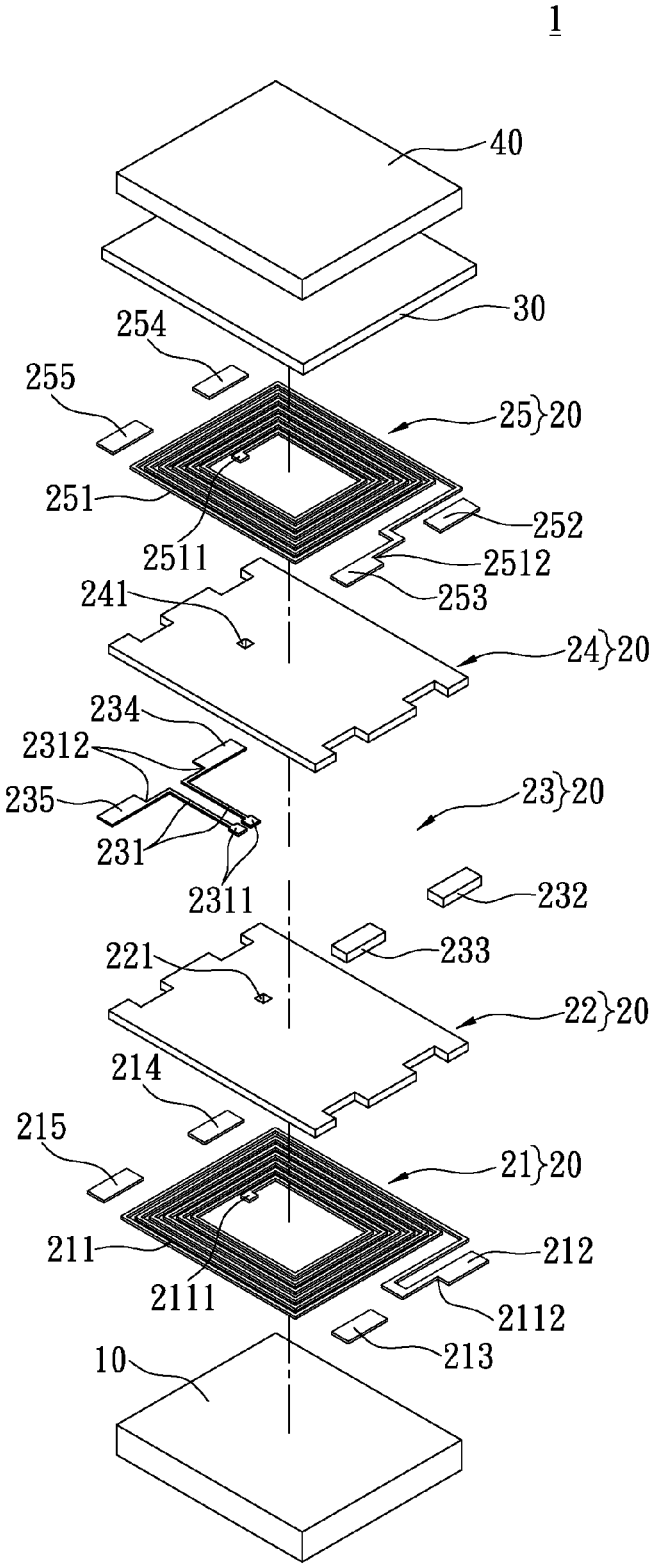
FIG. 1 is a three-dimensional exploded view of a common mode filter according to the first embodiment of the instant disclosure.

Please refer to FIG. 1, The thin-film common mode filter 1 includes a non-magnetic insulating substrate 10, a stacked-layer structure 20, an insulating layer 30, and a magnetic layer 40.

The stacked-layer structure 20 is arranged on the non-magnetic insulating substrate 10 and includes a first coil body 21, a first electric insulating layer 22, a coil leading layer 23, a second electric insulating layer 24, and a second coil body 25 in sequential order. The magnetic layer 40 covering the stacked-layer structure 20 by the insulating layer 30 interposed therebetween to increase inductance effect of the common mode filter 1. In this embodiment, the insulating layer 30 can be, but not limited to, an adhesive layer.

The specific features of the stacked-layer structure 20 are described as follows. The first coil body 21 includes a first spiral coil 211, a first electrode 212, a second electrode 213, a third electrode 214, and a fourth electrode 215. Moreover, the first spiral coil 211 has an inner end portion 2111 and an outer end portion 2112 formed thereon, wherein the outer end portion 2112 is electrically connected to the first electrode 212.

The coil leading layer 23 is stacked above the first coil body 21 and includes a pair of L-shaped coils 231, a first electrode 232, a second electrode 233, a third electrode 234, and a fourth electrode 235. Moreover, each of the L-shaped coil 231 has an inner end portion 2311 and an outer end portion 2312 formed thereon, and the outer end portions 2312 are respective electrically connected to the third electrode 234 and the fourth electrode 235.

The first electric insulating layer 22 has an upper surface and a lower surface, the first coil body 21 and the coil leading layer 23 are arranged on the upper surface and the lower surface respectively. Moreover, the first electric insulating layer 22 has a first conducting structure 221 formed thereon, the inner end portion 2111 of the first spiral coil 211 and the inner end portion 2311 of one of the L-shaped coils 231 are respective electrically connected to the first conducting structure 221 to achieve electrical connection between the first coil body 21 and the coil leading layer 23.

The second coil body 25 is stacked above the coil leading layer 23 and includes a second spiral coil 251, a first electrode 252, a second electrode 253, a third electrode 254, and a fourth electrode 255. Moreover, the second spiral coil 251 has an inner end portion 2511 and an outer end portion 2512 formed thereon, wherein the outer end portion 2512 is electrically connected to the second electrode 253. Specially, the first and second spiral coils 211, 251 can be magnetically coupled to be utilized in common to eliminate common mode noise.

The second electric insulating layer 24 has an upper surface and a lower surface, the second coil body 25 and the coil leading layer 23 are arranged on the upper surface and the lower surface respectively. Moreover, the second electric insulating layer 24 has a second conducting structure 241 formed thereon, the inner end portion 2311 of another one of the L-shaped coils 231 and the inner end portion 2511 of the second spiral coil 251 are respective electrically connected to the second conducting structure 241 to achieve electrical connection between the coil leading layer 23 and the second coil body 25. In this embodiment, the first and second conducting structures 221, 241 can be, but not limited to, via holes or connecting pillars.

Preferably, the first spiral coil 211 and the second spiral 251 may be in the form of a rectangular spiral as shown. Alternatively, they may have other spiral shapes such as a shape of circular spiral. The first spiral coil 211 and the second spiral 251 may have the same of the coil windings, and they may be substantially overlapped in the direction which is perpendicular to the non-magnetic insulating substrate 10.

Figure 2:
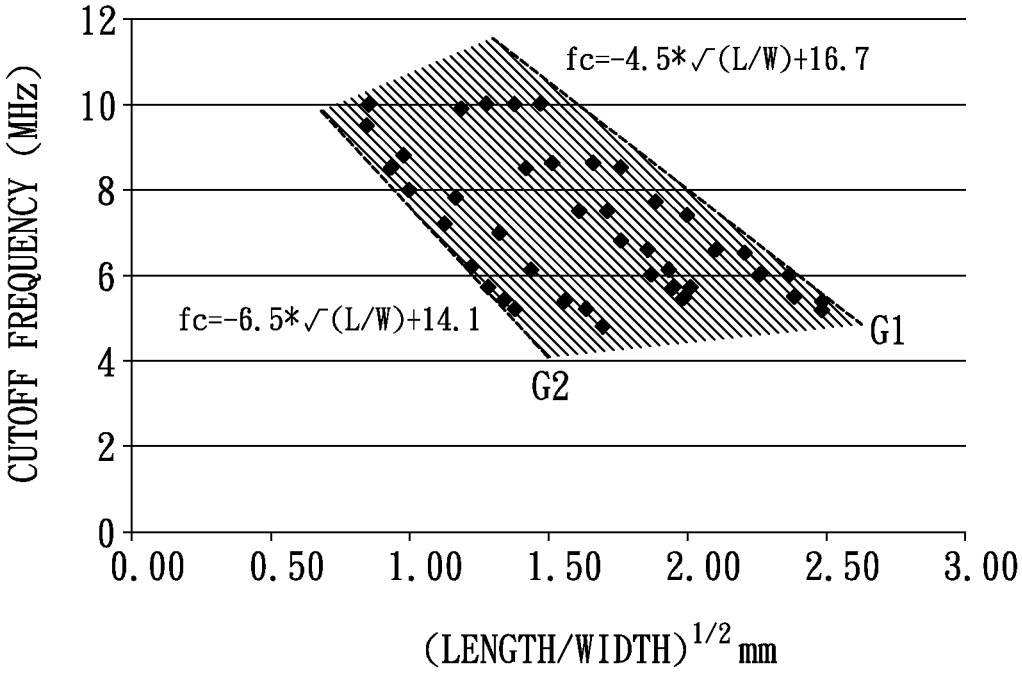
FIG. 2 is a graph showing the relationship between a total length L (mm) divided by a width W (mm) and a cutoff frequency according to the first embodiment of the instant disclosure.

Please refer to FIG. 2, which is a graph showing the relationship between a total length L (mm) divided by a width W (mm) and a cutoff frequency. So as you can see, the cutoff frequency of the common mode filter 1 can satisfy the following relationship by stacking the first and second spiral coils 211, 251 above the non-magnetic insulating substrate 10.

$$[(14.1-fc)/6.5]^2<L/W<[(16.7-fc)/4.5]^2$$

where fc (MHz) is the cutoff frequency of a differential-mode signal.

Concretely speaking, every node point of the cutoff frequency in correspondence with the total length L (mm) divided by a width W (mm) falls into the scope of the first trend line G1 and the second trend line G2. In other words, the cutoff frequency generated by the thin-film common mode filter 1 is about 4 to 10 MHz such that the thin-film common mode filter 1 can meet the requirement of the specific portable electronic devices.

In this embodiment, the first coil body 21, the coil leading layer 23, and the second coil body 25 may made of conducting material of Ag, Pd, Al, Cr, Ni, Ti, Au, Cu, or Pt and can be formed by a depositing process, a lithography process, and a etching process in sequential order. The first electric insulating layer 22 and the second electric insulating layer 24 may be made of electrical insulating material of polyimide, epoxy, or benzocyclobutene (BCB) and can be formed by a spin-coating process, a dipping process, a spraying process, a screen-printing process, or a thin film process, wherein Said electrical insulating material has better electrical and mechanical property.

The magnetic layer 40 may be a magnetic substrate or a colloid comprising magnetic powder, wherein the colloid can be made by mixing the magnetic powder with the material comprising polyimide, epoxy, or benzocyclobutene (BCB). Similarly, the magnetic layer 40 can be formed by a spin-coating process, a dipping process, a spraying process, a screen-printing process, or a thin film process.

The Second Embodiment

Figure 3A:
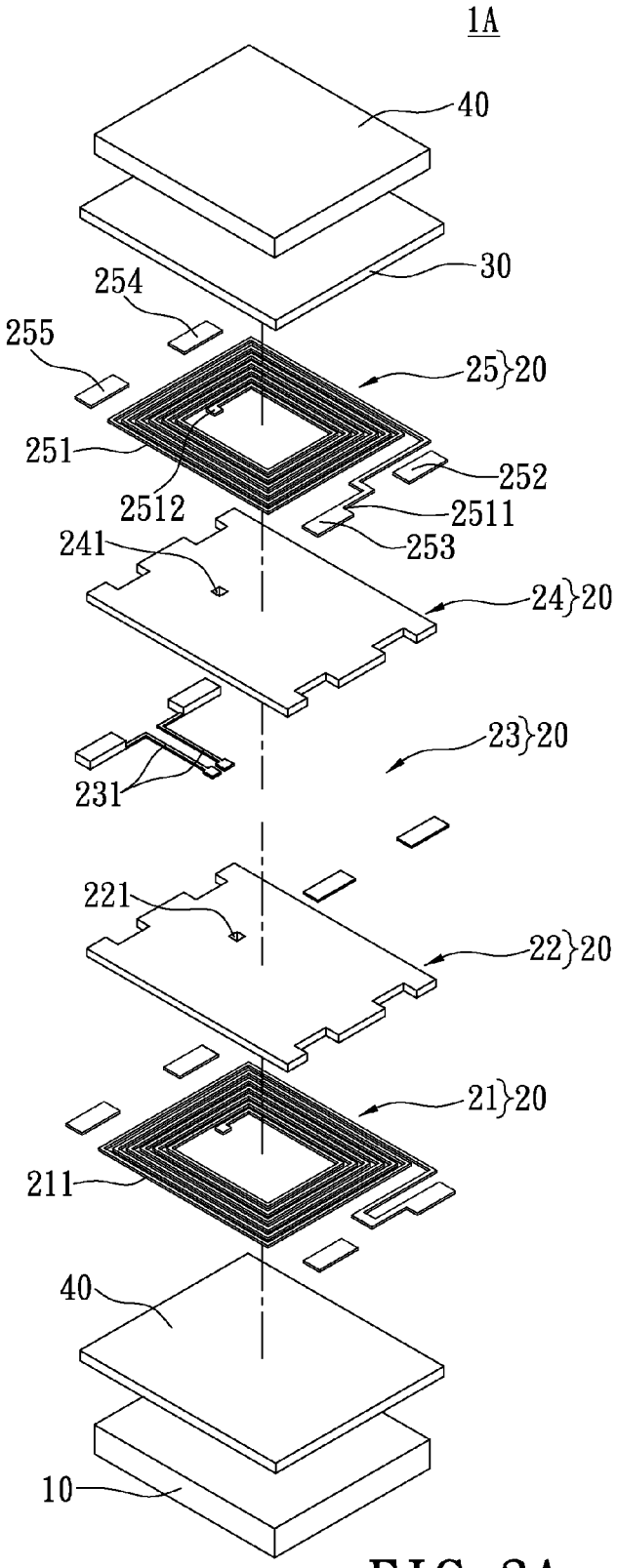
FIG. 3A is a three-dimensional exploded view of a common mode filter according to the second embodiment of the instant disclosure.

Please refer to FIG. 3A, which shows a common mode filter in accordance to the second embodiment of the instant disclosure. The difference in the second embodiment is that the common mode filter 1A further comprises another magnetic layer 40. Said another magnetic layer 40 is arranged between the non-magnetic insulating substrate 10 and the stacked-layer structure 20.

Concretely speaking, said another magnetic layer 40 is arranged between the non-magnetic insulating substrate 10 and the first coil body 21 to achieve better eliminating efficiency of the common mode noise. Similarly, a width W (mm) and a length L (mm) of at least one spiral coil in the first and second spiral coils 211, 251 satisfy the relational expression of:

$$[(14.1-fc)/6.5]^2<L/W<[(16.7-fc)/4.5]^2$$

where fc (MHz) is the cutoff frequency of a differential-mode signal. Thereby, the cutoff frequency generated by the thin-film common mode filter 1A is about 4 to 10 MHz such that the thin-film common mode filter 1A can meet the requirement of the specific portable electronic devices.

The Third Embodiment

Figure 3B:
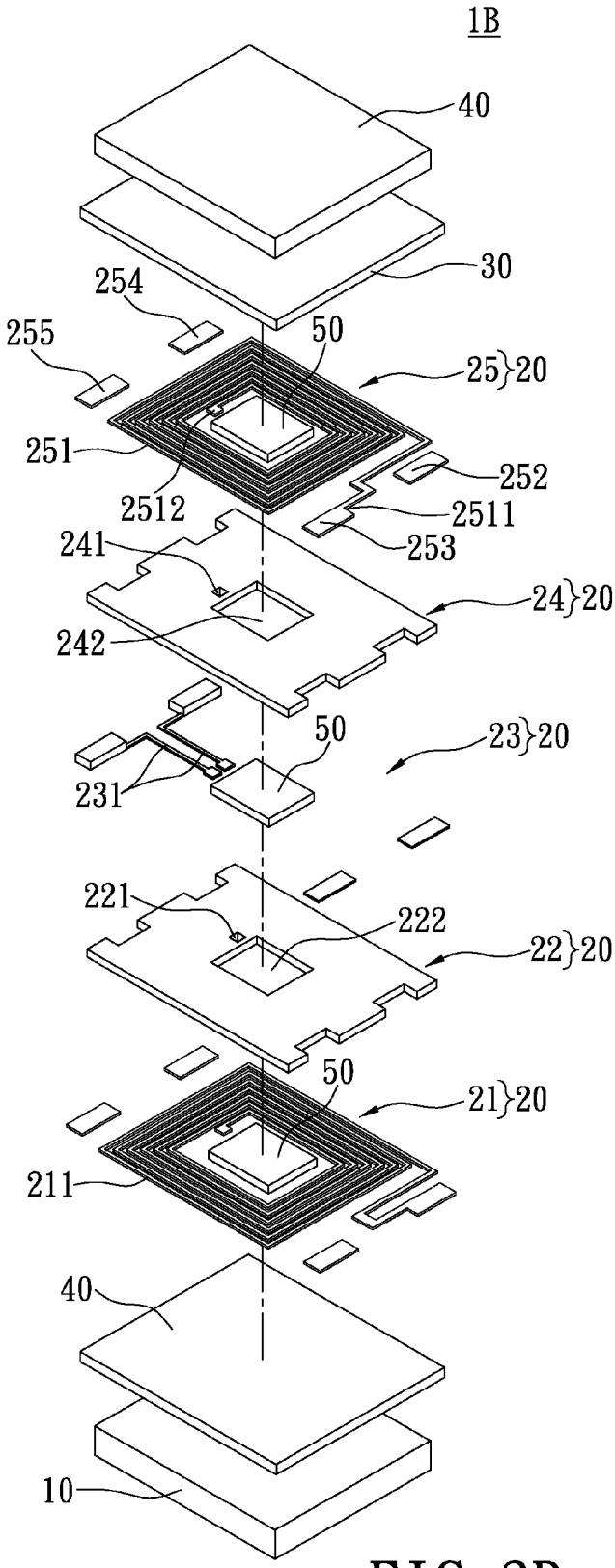
FIG. 3B is a three-dimensional exploded view of a common mode filter according to the third embodiment of the instant disclosure.

Please refer to FIG. 3B, which shows a common mode filter in accordance to the third embodiment of the instant disclosure. The difference in the third embodiment is that the common mode filter 1B comprises a plurality of magnetic members 50 having the advantages of high resistance and low eddy current loss in a wild range of frequencies. In this embodiment, the magnetic members 50 can be, but not limited to ferrite cores.

In addition, each of the first and second electric insulating layers 22, 24 has a through-hole 222, 242 formed thereon near the first and the second conducting structures 221, 241 respectively. The magnetic members 50 respectively arranged inside the first, second spiral coils 211, 251 and near one end of the L-shaped coils 231 through the through-holes 222, 242 to increase the magnetic field intensity between the first and the second coil body 21, 25 (means that cross magnetic field intensity between the first and the second spiral coils 211, 251) to further increase the common mode impedance and the stability of the common mode filter 1B.

Similarly, a width W (mm) and a length L (mm) of at least one spiral coil in the first and second spiral coils 211, 251 satisfy the relational expression of:

$$[(15.4-fc)/14.3]^2<L/W<[(18.2-fc)/12.0]^2$$

Where fc (MHz) is the cutoff frequency of a differential-mode signal. Thereby, the cutoff frequency generated by the thin-film common mode filter 1B is about 4 to 10 MHz such that the thin-film common mode filter 1B can meet the requirement of the specific portable electronic devices.

The Fourth Embodiment

Figure 4:
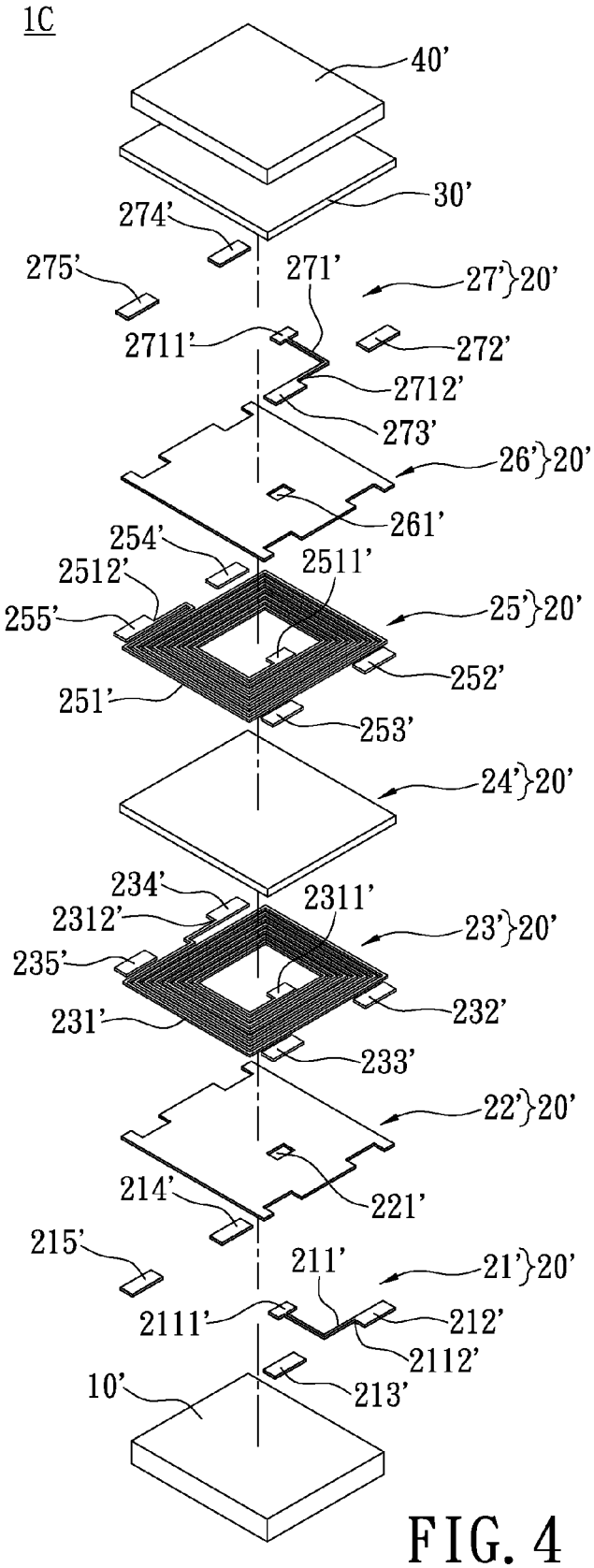
FIG. 4 is a three-dimensional exploded view of a common mode filter according to the fourth embodiment of the instant disclosure.

Please refer to FIG. 4, which shows a common mode filter 1C in accordance to the fourth embodiment of the instant disclosure. The common mode filter 1C includes a non-magnetic insulating substrate 10', a stacked-layer coil 20', an insulating layer 30', and a magnetic layer 40'.

Concretely speaking, the common mode filter 1C includes a lower leading layer 21', a first electric insulating layer 22', a first coil body 23', a second electric insulating layer 24', a second coil body 25', a third electric insulating layer 26', and an upper leading layer 27' in sequential order to generate a wide-ranged cutoff frequency.

The lower leading layer 21' is arranged on the non-magnetic insulating substrate 10' and includes a L-shaped coil 211', a first electrode 212', a second electrode 213', a third electrode 214', and a fourth electrode 215'. Moreover, the L-shaped coil 211' has an inner end portion 2111' and an outer end portion 2112' formed thereon, wherein the outer end portion 2112' is electrically connected to the first electrode 212'.

The first coil body 23' is stacked above the lower leading layer 21' and includes a first spiral coil 231', a first electrode 232', a second electrode 233', a third electrode 234', and a fourth electrode 235'. Moreover, the first spiral coil 231' has an inner end portion 2311' and an outer end portion 2312' formed thereon, wherein the outer end portion 2312' is electrically connected to the third electrode 234'.

The first electric insulating layer 22' has an upper surface and a lower surface, the lower leading layer 21' and the first coil body 23' are arranged on the upper surface and the lower surface respectively. Moreover, the first electric insulating layer 22' has a first conducting structure 221' formed thereon, the inner end portion 2111' of the L-shaped coil 211' and the inner end portion 2311' of the first spiral coil 231' are respective electrically connected to the first conducting structure 221' to achieve the electrical connection between the lower leading layer 21' and the first coil body 23'.

The second coil body 25' is stacked above the first coil body 23' and includes a second spiral coil 251', a first spiral coil 251', a first electrode 252', a second electrode 253', a third electrode 254', and a fourth electrode 255'. Moreover, the second spiral coil 251' has an inner end portion 2511' and an outer end portion 2512' formed thereon, wherein the outer end portion 2512' is electrically connected to the fourth electrode 255'.

The second electric insulating layer 24' has an upper surface and a lower surface, the first coil body 23' and the second coil body 25' are arranged on the upper surface and the lower surface respectively such that the first and second spiral coils 231', 251' can be magnetically coupled to be utilized in common to eliminate common mode noise.

The upper leading layer 27' is stacked above the second coil body 25' and includes a L-shaped coil 271', a first electrode 272', a second electrode 273', a third electrode 274', and a fourth electrode 275'. Moreover, the L-shaped coil 271' has an inner end portion 2711' and an outer end portion 2712' formed thereon, wherein the outer end portion 2712' is electrically connected to the second electrode 273'.

The third electric insulating layer 26' has an upper surface and a lower surface, the upper leading layer 27' and the second coil body 25' are arranged on the upper surface and the lower surface respectively. Moreover, the third electric insulating layer 26' has a second conducting structure 261' formed thereon, the inner end portion 2711' of the L-shaped coil 271' and the inner end portion 2511' of the second spiral coil 251' are respective electrically connected to the second conducting structure 261' to achieve the electrical connection between the upper leading layer 27' and the second coil body 25'. In this embodiment, the first and second conducting structures 221', 261' can be, but not limited to, via holes or connecting pillars.

Preferably, the first spiral coil 231' and the second spiral 251' may be in the form of a rectangular spiral. Alternatively, they may have other spiral shapes such as a shape of circular spiral. The first spiral coil 231' and the second spiral 251' may have the same of the coil windings, and they may be substantially overlapped in the direction which is perpendicular to the non-magnetic insulating substrate 10'.

Figure 5:
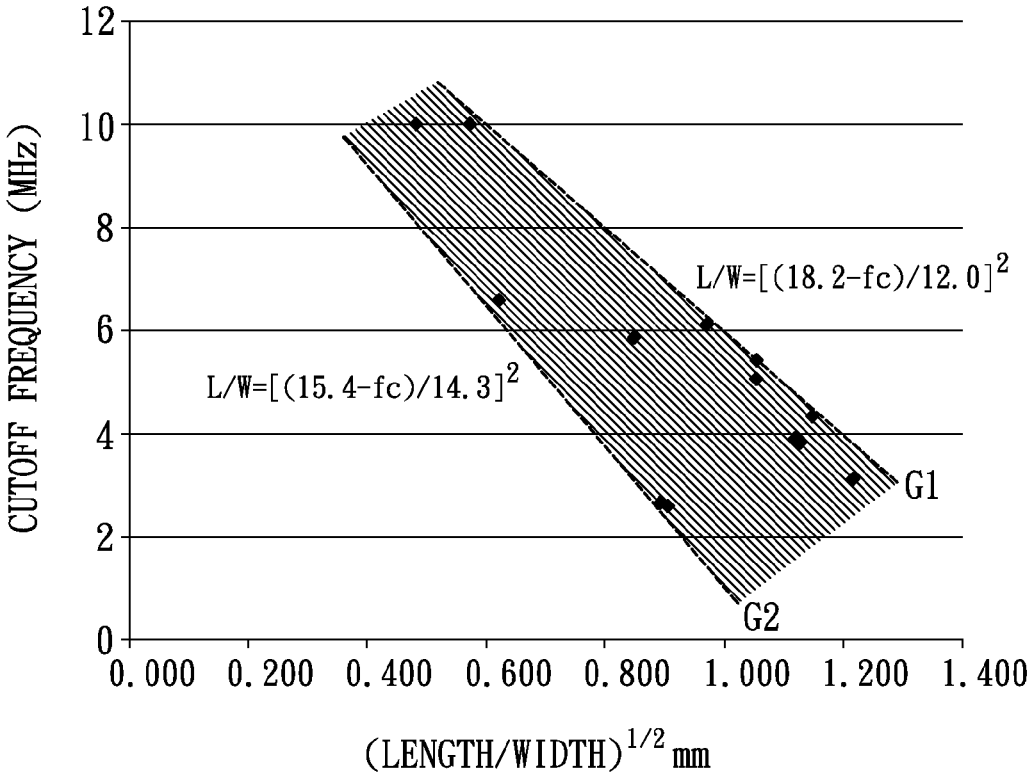
FIG. 5 is a graph showing the relationship between a total length L (mm) divided by a width W (mm) and a cutoff frequency according to the fourth embodiment of the instant disclosure.

Please refer to FIG. 5, which is a graph showing the relationship between a total length L (mm) divided by a width W (mm) and a cutoff frequency. So as you can see, the cutoff frequency of the common mode filter 1C can satisfy the following relationship by stacking the first and second spiral coils 231', 251' above the non-magnetic insulating substrate 10'.

$$[(15.4-fc)/14.3]^2<L/W<[(18.2-fc)/12.0]^2$$

where fc (MHz) is the cutoff frequency of a differential-mode signal.

Concretely speaking, every node point of the cutoff frequency in correspondence with the total length L (mm) divided by a width W (mm) falls into the scope of the first trend line G1 and the second trend line G2. In other words, the cutoff frequency generated by the common mode filter 1C is about 2 to 10 MHz such that the common mode filter 1C can meet the requirement of the specific portable electronic devices.

The Fifth Embodiment

Figure 6A:
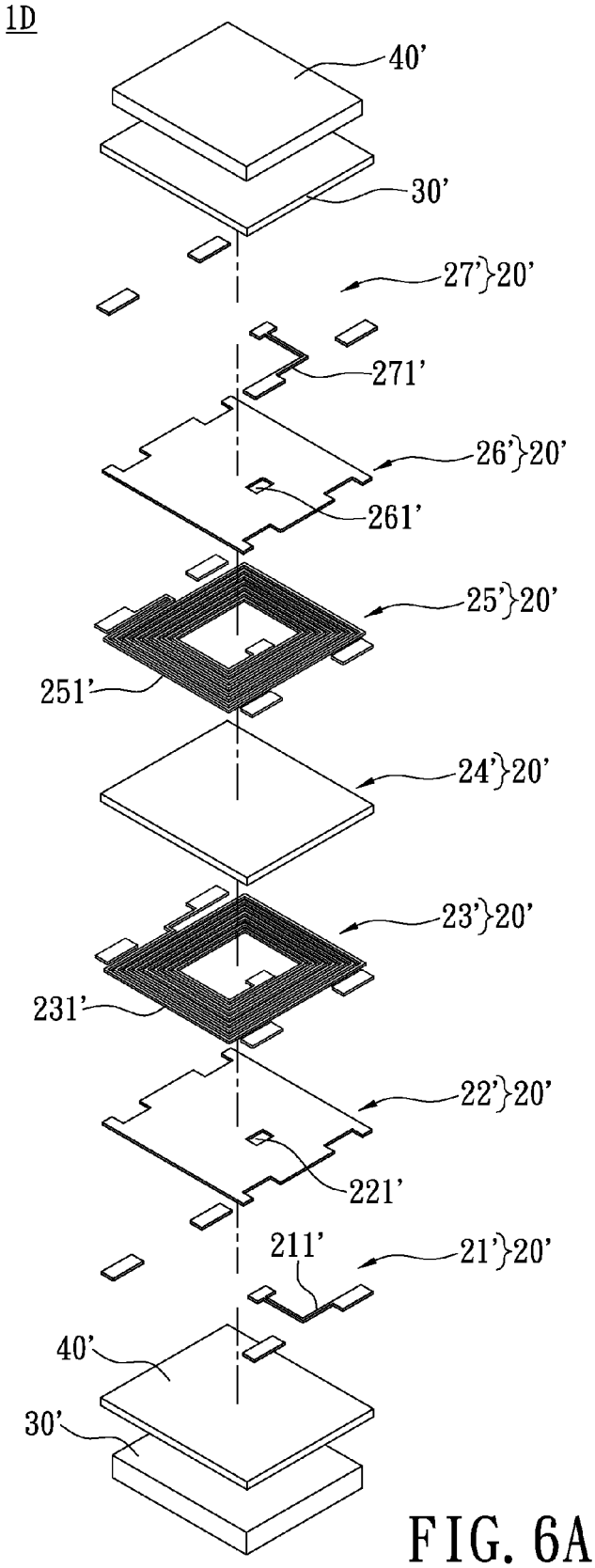
FIG. 6A is a three-dimensional exploded view of a common mode filter according to the fifth embodiment of the instant disclosure.

Please refer to FIG. 6A, which shows a common mode filter 1D in accordance to the fifth embodiment of the instant disclosure. The difference in the fifth embodiment is that the common mode filter 1D further comprises another magnetic layer 40'. Said another magnetic layer 40 is arranged between the non-magnetic insulating substrate 10' and the stacked-layer structure 20'.

Concretely speaking, said another magnetic layer 40' is arranged between the non-magnetic insulating substrate 10' and the lower leading layer 21' to achieve better eliminating efficiency of the common mode noise. Similarly, a width W (mm) and a length L (mm) of at least one spiral coil in the first and second spiral coils 231', 251' satisfy the relational expression of:

$$[(15.4-fc)/14.3]^2<L/W<[(18.2-fc)/12.0]^2$$

where fc (MHz) is the cutoff frequency of a differential-mode signal. Thereby, the cutoff frequency generated by the thin-film common mode filter 1A is about 2 to 10 MHz such that the thin-film common mode filter 1D can meet the requirement of the specific portable electronic devices.

The Sixth Embodiment

Figure 6B:
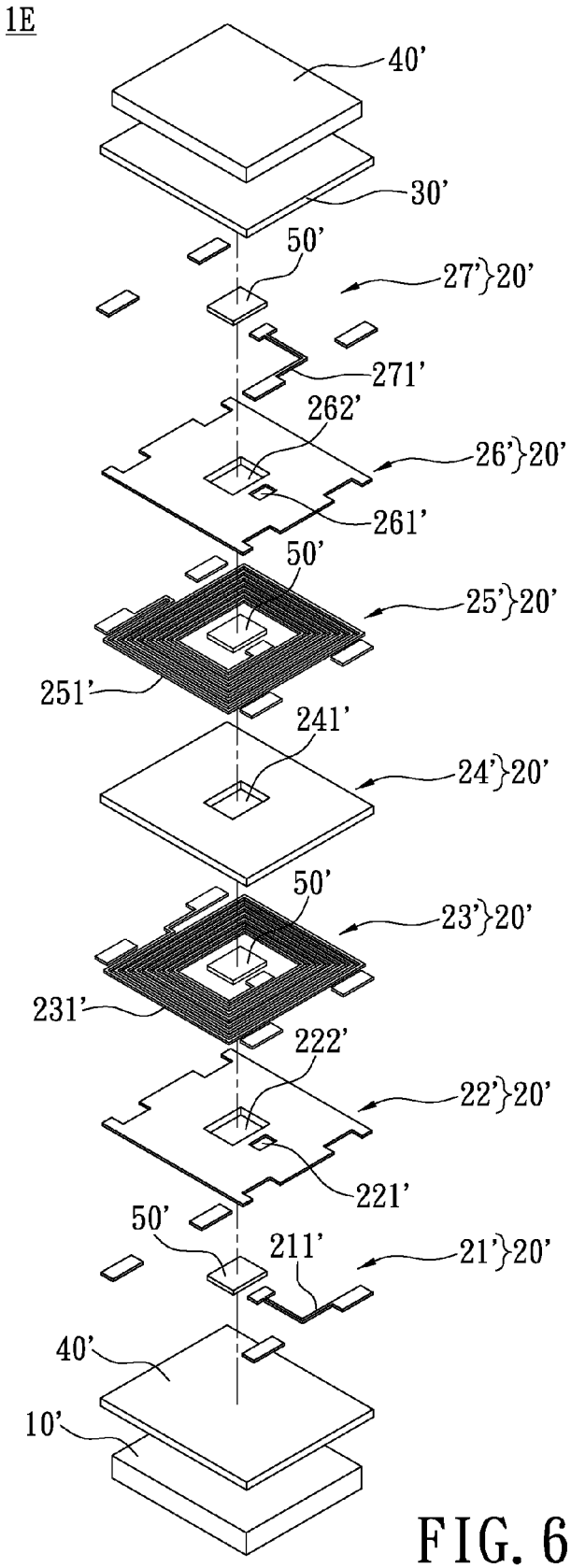
FIG. 6B is a three-dimensional exploded view of a common mode filter according to the sixth embodiment of the instant disclosure.

Please refer to FIG. 6B, which shows a common mode filter 1E in accordance to the fifth embodiment of the instant disclosure. The difference in the fifth embodiment is that the common mode filter 1D comprises a plurality of magnetic members 50' having the advantages of high resistance and low eddy current loss in a wild range of frequencies. In this embodiment, the magnetic members 50' can be, but not limited to ferrite cores.

In addition, each of the first and third electric insulating layers 22', 26' has a through-hole 222', 262' formed thereon near the first and the second conducting structure respectively 221', 261'. The second electric insulating layers 24' has a through-hole 241' formed thereon in correspondence with the through-hole 222' of the second insulating layers 22' and the through-hole 262' of the third insulating layers 26'. The magnetic members 50' respectively arranged inside the first, second spiral coils 231', 251' and near one end of the L-shaped coils 211', 231' through the through-holes 222', 241', 262' to increase the stability of the common mode filter 1D. Similarly, a width W (mm) and a length L (mm) of at least one spiral coil in the first and second spiral coils 231', 251' satisfy the relational expression of:

$$[(15.4-fc)/14.3]^2<L/W<[(18.2-fc)/12.0]^2$$

Where fc (MHz) is the cutoff frequency of a differential-mode signal. Thereby, the cutoff frequency generated by the common mode filter 1D is about 2 to 10 MHz such that the common mode filter 1D can meet the requirement of the specific portable electronic devices.

Base on above, the first and second spiral coils can be magnetically coupled to be used in common to eliminate common mode noise. In addition, the common mode filter is effective in maintaining range of the cutoff frequency by stacking the first and second spiral coils above the non-magnetic insulating substrate to accurately control the common mode impedance and achieve the purpose of miniaturization.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A common mode filter, comprising:

a non-magnetic insulating substrate;

a first coil body, comprising a first spiral coil arranged on the non-magnetic insulating substrate;

a coil leading layer, stacked above the first coil body;

a first electric insulating layer, arranged between the first coil body and the coil leading layer and has a first conducting structure formed thereon, wherein the first coil body and coil leading layer respective electrically coupled to the first conducting structure;

a second coil body, comprising a second spiral coil stacked above the coil leading layer;

a second electric insulating layer, arranged between the coil leading layer and the second coil body and has a second conducting structure formed thereon, wherein the coil leading layer and the second coil body respective electrically coupled to the second conducting structure;

an insulating layer, arranged on the second coil body; and a magnetic layer, arranged on the insulating layer;

wherein a width W (mm) and a length L (mm) of at least one spiral coil in the first and second spiral coils satisfy the relational expression of:

$$[(14.1-fc)/6.5]^2<L/W<[(16.7-fc)/4.5]^2$$

where fc (MHz) is the cutoff frequency of a differential-mode signal.

2. The common mode filter according to claim 1, further comprising another magnetic layer, arranged between the non-magnetic insulating substrate and the first coil body.

3. The common mode filter according to claim 1, further comprising a plurality of magnetic members, each of the first and second electric insulating layers has a through-hole formed thereon, the coil leading layer comprises a pair of L-shaped coils, the magnetic members respectively arranged inside the first, second spiral coils and near one end of the L-shaped coils through the through-holes.

4. The common mode filter according to claim 3, wherein the first electric insulating layer has the through-hole formed thereon near the first conducting structure, the second electric insulating layer has the through-hole formed thereon near the second conducting structure.

5. The common mode filter according to claim 1, wherein the non-magnetic insulating substrate is a substrate of aluminum oxide, aluminum nitride, glass, or quartz.

* * * * *